US009219315B2

(12) United States Patent
Säilä et al.

(10) Patent No.: US 9,219,315 B2
(45) Date of Patent: Dec. 22, 2015

(54) COMBINATION ANTENNA

(75) Inventors: Juhani Säilä, Helsinki (FI); Kari Repo, Mustio (FI)

(73) Assignee: COJOT OY, Espoo (FI)

( * ) Notice: Subject to any disclaimer, the term of this patent is extended or adjusted under 35 U.S.C. 154(b) by 148 days.

(21) Appl. No.: 13/702,903

(22) PCT Filed: May 25, 2011

(86) PCT No.: PCT/FI2011/050478

§ 371 (c)(1),
(2), (4) Date: Dec. 7, 2012

(87) PCT Pub. No.: WO2011/154593

PCT Pub. Date: Dec. 15, 2011

(65) Prior Publication Data

US 2013/0082887 A1 Apr. 4, 2013

(30) Foreign Application Priority Data

Jun. 8, 2010 (FI) ..... 20105649

(51) Int. Cl.

| | |
|---|---|
| ***H01Q 9/16*** | (2006.01) |
| ***H01Q 21/28*** | (2006.01) |
| ***H01Q 1/52*** | (2006.01) |
| ***H01Q 9/30*** | (2006.01) |
| ***H01Q 5/321*** | (2015.01) |

(52) U.S. Cl.

CPC ..... *H01Q 21/28* (2013.01); *H01Q 1/52* (2013.01); *H01Q 5/321* (2015.01); *H01Q 9/16* (2013.01); *H01Q 9/30* (2013.01)

(58) Field of Classification Search

CPC ..... H01Q 21/28; H01Q 1/52; H01Q 5/321; H01Q 9/30; H01Q 9/16

USPC ..... 343/790, 791, 792, 793

See application file for complete search history.

(56) References Cited

U.S. PATENT DOCUMENTS

| | | | | |
|---|---|---|---|---|
| 3,879,735 | A | 4/1975 | Campbell et al. | |
| 4,217,589 | A * | 8/1980 | Stahler | 343/722 |
| 4,872,021 | A * | 10/1989 | Tabakov et al. | 343/801 |
| 7,053,851 | B1 * | 5/2006 | Bogdans et al. | 343/792 |
| 2004/0056817 | A1 * | 3/2004 | Tsai et al. | 343/792 |
| 2008/0158083 | A1 * | 7/2008 | Apostolos | 343/791 |
| 2009/0140939 | A1 * | 6/2009 | Bongfeldt et al. | 343/713 |
| 2011/0151779 | A1 * | 6/2011 | Bongfeldt et al. | 455/39 |

FOREIGN PATENT DOCUMENTS

| | | |
|---|---|---|
| EP | 0 470 797 A2 | 2/1992 |
| GB | 1 247 629 | 9/1971 |
| JP | 4-95403 A | 3/1992 |

* cited by examiner

*Primary Examiner* — Hoanganh Le

(74) *Attorney, Agent, or Firm* — Birch, Stewart, Kolasch & Birch, LLP

(57) ABSTRACT

Combination antenna, which comprises two different antenna parts, of which the first antenna part is fitted to operate at a lower frequency range and the second antenna part is fitted to operate at a higher frequency range. The second antenna part of the combination antenna is arranged above the first antenna part. The supply cable of the second antenna part (102) of the combination antenna is arranged to travel in connection with the first antenna part. The first antenna part comprises two or more radiator parts (104, 106, 108) and also coils (112) between them, wherein the coil or coils (112) are formed from the supply cable of the second antenna part (102).

8 Claims, 3 Drawing Sheets

COMBINATION ANTENNA

FIELD OF THE INVENTION

The invention relates to antennas and more particularly to combination antennas.

BACKGROUND OF THE INVENTION

Modern telecommunications technology and standards enable communications in many different frequency ranges. Combination antennas enable transmitting and receiving with one antenna in a wide frequency range, from low frequencies up to high frequencies. Combination antennas can be used e.g. for maintaining a number of different telecommunication contacts, as a transmitter antenna and receiver antenna of many different systems, or as a jamming transmitter e.g. in military applications. Combination antennas comprise different antenna parts for different frequency ranges. Combination antennas can be used e.g. in fixed installation sites or as antennas to be fixed to vehicles.

Various combination antennas are presented in prior art. One prior-art combination antenna is presented in patent publication U.S. Pat. No. 7,339,542. The patent presents an antenna system, which is formed from one pipe-shaped antenna structure, which comprises an asymmetric dipole, which is supplied from a bicone-dipole. The bicone-dipole covers high-frequency ranges and the asymmetric dipole covers intermediate frequency ranges. The solution of the publication also presents the fact that the two dipoles described above together form a structure that operates as an antenna of a low frequency range.

A problem of prior-art antennas is that their structure does not enable a good radiation efficiency. Another problem of prior art is that combination antennas are large in size and the whole structure of the antenna cannot be made a part of a radiator. One of the problems of prior-art combination antennas to be formed from a number of antenna parts is also that the supply cable of one antenna part interferes with the operation of the other antenna part.

BRIEF DESCRIPTION OF THE INVENTION

The aim of the invention is to improve the structure and properties of antennas so that the problems and deficiencies of prior art can be solved with an antenna according to the invention.

The combination antenna according to the invention is formed from two antenna parts that are one on top of the other. One of the antenna parts is an antenna part of a lower frequency range and the other is an antenna part of a higher frequency range. In the solution according to the invention the antenna part of a higher frequency range is disposed on top of the antenna part of a lower frequency range. According to one embodiment of the invention the lower antenna part is a ground-plane antenna and the upper antenna part is a bicone-dipole antenna. The supply lead of the antenna part of a higher frequency range is arranged in connection with the antenna part of a lower frequency range. The ground-plane antenna can contain one or more cut-off points, which are implemented by adding, between the different radiator parts of the ground-plane antenna, inductances connected in series with the radiator parts. By means of the cut-offs, the current distributions occurring in the radiator, and therefore the radiation pattern, can be affected.

So that the supply leads of the antenna part of a higher frequency range would not disturb the antenna part of a lower frequency range, the sheath of the coaxial supply cable of the antenna part of a higher frequency range is insulated from the ground potential, in the operating frequency range of the antenna, already in the root of the antenna. Insulation from ground potential can be implemented e.g. by winding the supply cable into a coil. In addition, the separate cut-off coil(s) of the antenna part of a lower frequency range can be omitted by winding the supply cable of the upper antenna part into a coil at the point of the cut-off coils such that the sheath of the cable forms an inductance of a value that a cut-off coil would need to have. With this method the signal of the upper antenna part can be supplied without disturbing the operation of the lower antenna.

One advantage, among others, of a combination antenna according to the invention compared to prior-art solutions is that the supply lead of a higher frequency range can be integrated without losses into the radiator of a lower frequency range and this enables good radiation efficiency. By means of the invention, an optimized size of an antenna is also obtained, because all the structure of the antenna can be made a part of a radiator. The solution of the combination antenna of the invention also enables the use of a ground-plane antenna such that a number of cut-offs can be added to a radiator for achieving a wide frequency band. By implementing the cut-offs of the ground-plane antenna by means of the supply cable of the antenna part of a higher frequency range, the use of extra components is also avoided because separate cut-off components are not needed.

A combination antenna according to the invention can be used e.g. as an antenna to be fixed to a vehicle. The antenna can be e.g. 1-2 meters in length.

BRIEF DESCRIPTION OF THE FIGURES

In the following, the invention will be described in more detail with the aid of some examples of its embodiment with reference to the drawings, wherein.

DETAILED DESCRIPTION OF THE INVENTION

The combination antenna according to the invention comprises two antenna parts, which can be installed e.g. one on top of the other. One of the antenna parts operates as an antenna of a lower frequency range and the other antenna part as an antenna of a higher frequency range. The frequency range of the antenna part of a lower frequency range can be e.g. 20 MHz-500 MHz and the frequency range of the antenna part of a higher frequency range e.g. 500 MHz-6 GHz.

A combination antenna according to the invention can be used e.g. for maintaining a number of different telecommunication contacts, as a transmitter antenna of many different systems, or as a jamming transmitter e.g. in military applications. The combination antenna can be fixed e.g. to a fixed installation site or to a mounting base of a vehicle.

Figure 1:
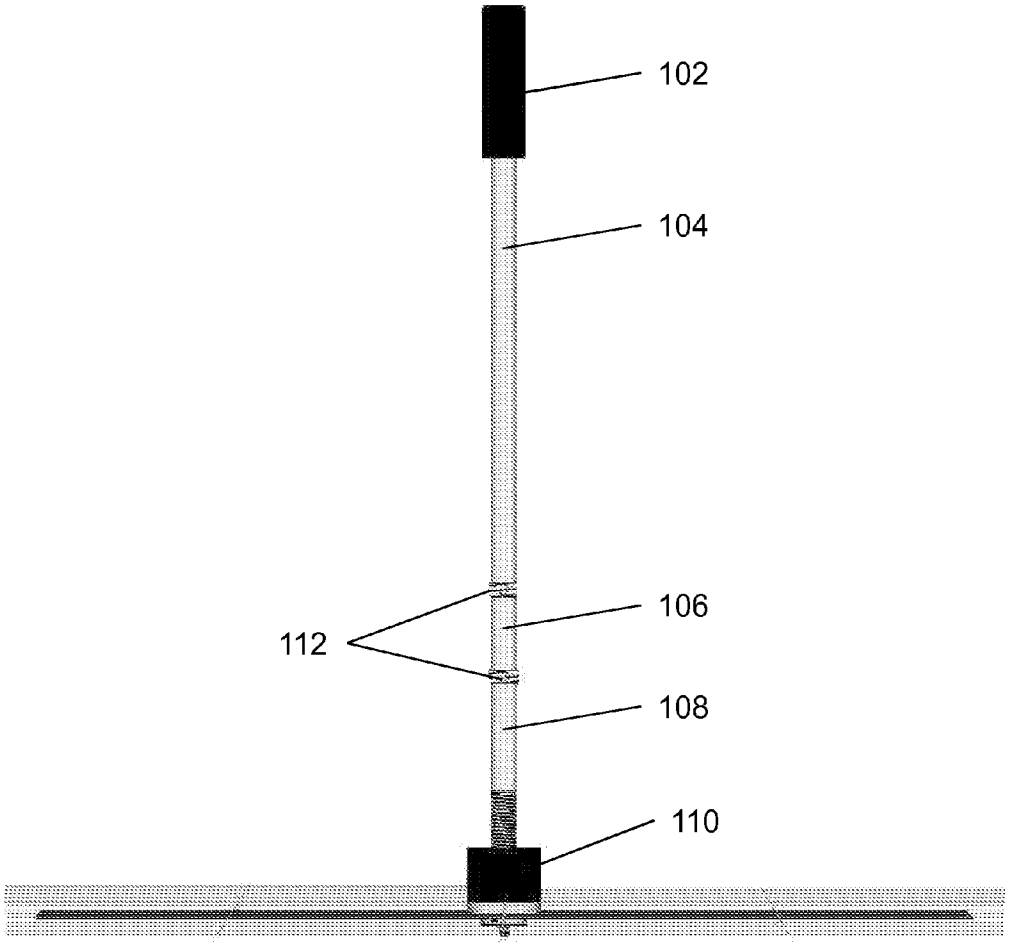
FIG. 1 presents the structure of one combination antenna according to the invention.

FIG. 1 presents the structure of one combination antenna according to the invention. The antenna part 102 of a higher frequency range of the combination antenna is arranged on top of the antenna part of a lower frequency range. The antenna can be fixed e.g. to a vehicle or to another surface by means of a bracket 110. According to one embodiment of the invention the antenna part 102 of a higher frequency range can be a bicone-dipole antenna and the antenna part of a lower frequency range can be e.g. a ground-plane antenna. The antenna part of a lower frequency range can be formed from a number of pipe-shaped radiator parts 104, 106, 108. The radiator parts can be separated from each other with a cut-off at one or more points. The cut-offs can be implemented with coils 112. With a cut-off the current distributions occurring in the radiator, and therefore the radiation patterns of an antenna part, can be affected.

The supply cables of both antennas are fixed to connectors in the root of the antenna. The supply cables of the antennas can be e.g. coaxial cable. The supply cable of the antenna part 102 of a higher frequency range is taken from the root of the antenna, via the antenna part of a lower frequency range, to the antenna part 102 of a higher frequency range.

The supply cable can travel at least partly inside the radiator parts 104, 106, 108 of the antenna part of a lower frequency range. The sheath of the coaxial supply cable is insulated from the ground potential, in the operating frequency range of the antenna, already in the root of the antenna. This is achieved by winding the cable into a sufficiently large inductance, in which case it forms a large impedance at the operating frequencies, which in practice insulates the upper part of the supply cable from the ground potential. The supply cable thus "floats" electrically and does not therefore disturb the straight sections of the radiator of the lower antenna passing beside it.

So that the supply cable does not cancel out the effect of the cut-off coils, the supply lead of the antenna part 102 of a higher frequency range is used as the cut-off coils 112 of the antenna of a lower frequency range. The supply cable is wound into a coil at the point of the cut-off coils 112 such that the sheath of the supply cable forms an inductance of essentially the same value that a separate cut-off coil would need to have. In this case a separate cut-off coil can be omitted.

By means of the solution according to the invention the supply cable of the antenna part 102 of a higher frequency range does not disturb the antenna part of a lower frequency range e.g. by bringing the radiator 104, 106, 108 of the antenna part of a lower frequency range too close to the ground potential.

Figure 2:
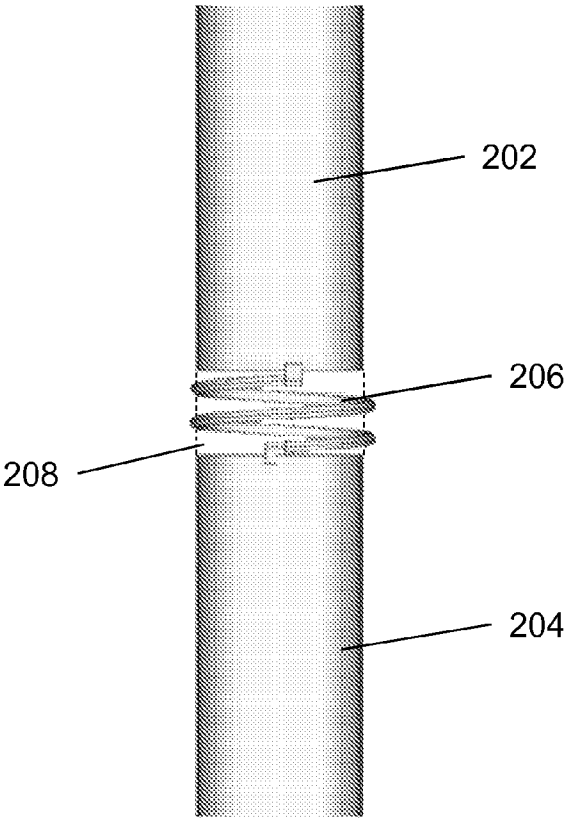
FIG. 2 presents an implementation of one cut-off coil of a combination antenna according to the invention.

FIG. 2 presents an implementation of a cut-off point in more detail. The supply cable 206 of a higher frequency range travels inside the other radiator part up to the cut-off point where it is wound cylindrically into a coil in the direction of the radiator parts 202, 204 of the first antenna part. There can be one or more turns in a coil. The supply cable 206 travels after the coil inside the other radiator part 202 towards the antenna part of a higher frequency range. The area of the cut-off point can have a core part 208, which is of e.g. insulating material, and the supply cable can be arranged into a coil around the core part 208.

Figure 3:
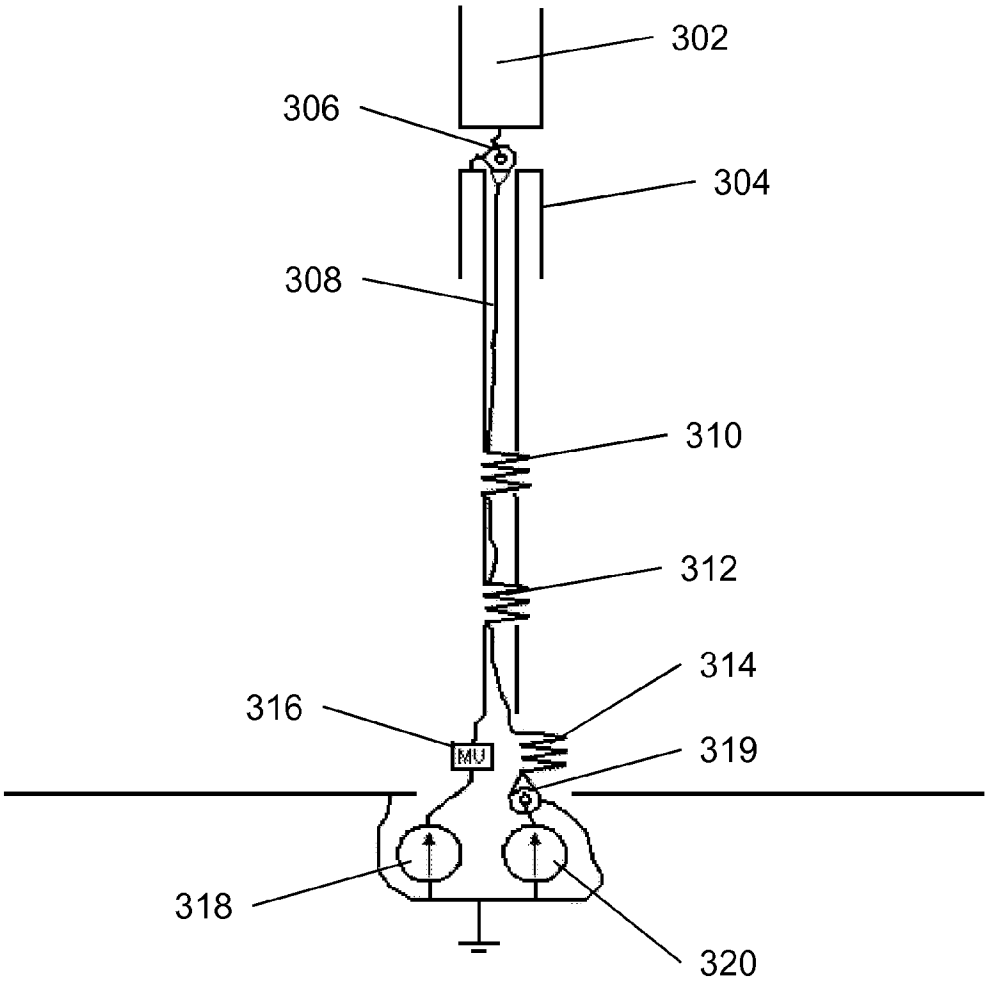
FIG. 3 presents an electrical schematic diagram of one combination antenna according to the invention.

FIG. 3 presents an electrical schematic diagram of an implementation of a combination antenna according to one embodiment of the invention. The root of the antenna comprises two signal sources 318, 320, of which one 318 is connected via a matching circuit 316 to supply the ground-plane antenna and the other 320 is connected by means of a coaxial cable 308 to supply the upper antenna that is independent of the ground plane. The ends 306 and 319 of the coaxial supply cable 308 are magnified in the figure.

The sheath of the coaxial cable 308 is insulated from the ground potential, in the operating frequency range of the antenna, already in the root of the antenna. Insulation from ground potential is implemented by winding the supply cable into a coil 314. The figure also presents the cut-off coils 310 and 312 of the lower antenna part, which are implemented by winding the supply cable 308 of the antenna part of a higher frequency range into a coil. The antenna part of a higher frequency range can be e.g. a bicone-dipolar-type antenna, which comprises two radiator parts 302, 304.

It is obvious to the person skilled in the art that the different embodiments of the invention are not limited solely to the examples described above, and that they may therefore be varied within the scope of the claims presented below.

The invention claimed is:

1. A combination antenna, comprising:

a ground plane antenna configured to operate at a lower frequency range;

a bicone-dipole antenna configured to operate at a higher frequency range, the bicone-dipole antenna being arranged above the ground plane antenna; and a coaxial supply cable of the bicone-dipole antenna connected between cut-off coils of the ground plane antenna and radiator parts of the bicone-dipole antenna, wherein the coaxial supply cable of the bicone-dipole antenna extends at least partly inside radiator parts of the ground plan antenna, and wherein the cut-off coils of the ground plane antenna are formed from the coaxial supply cable of the bicone-dipole antenna.

2. The combination antenna according to claim 1, wherein the coaxial supply cable of the bicone-dipole antenna has a sheath and is arranged to function as a coil.

3. The combination antenna according to claim 1, wherein the coaxial supply cable of the bicone-dipole antenna is cylindrically wound into one or more turns in a direction of the radiator parts of the ground plane antenna.

4. The combination antenna according to claim 2, wherein the sheath of the coaxial cable of the bicone-dipole antenna is insulated from ground potential.

5. The combination antenna according to claim 1, wherein the antenna is a broadband antenna, and wherein the frequency range of the ground plane antenna is in the range 20-500 Mhz and the frequency range of the bicone-dipole antenna is in the range 500 MHz-6 Ghz.

6. The combination antenna according to claim 2, wherein the coaxial supply cable of the bicone-dipole antenna is cylindrically wound into one or more turns in the direction of the radiator parts of the ground plane antenna.

7. The combination antenna according to claim 3, wherein the sheath of the coaxial supply cable of the bicone-dipole antenna is insulated from ground potential.

8. The combination antenna according to claim 1, wherein the sheath of the coaxial supply cable of the bicone-dipole antenna is insulated from ground potential.

* * * * *